United States Patent [19]

Clarke et al.

[11] 4,196,093

[45] Apr. 1, 1980

[54] PRODUCTION OF DETERGENT COMPOSITIONS

[75] Inventors: David E. Clarke; James F. Davies, both of Wirral; John B. Tune, Higher Bebington; Raymond J. Wilde, Wirral, all of England

[73] Assignee: Lever Brothers Company, New York, N.Y.

[21] Appl. No.: 905,681

[22] Filed: May 15, 1978

[30] Foreign Application Priority Data

May 18, 1977 [GB] United Kingdom ..... 20933/77

[51] Int. Cl.[2] ..... C11D 7/18; C11D 7/12

[52] U.S. Cl. ..... 252/99; 252/95; 252/135; 252/160; 252/173; 252/174.13; 252/174.14; 252/174.25

[58] Field of Search ..... 252/95, 99, 89 R, 135, 252/173, 174, 160

[56] References Cited

U.S. PATENT DOCUMENTS

| | | | |
|---|---|---|---|
| 4,013,578 | 3/1977 | Child et al. | 252/160 X |
| 4,051,054 | 9/1977 | Davies et al. | 252/89 R |

*Primary Examiner*—Mayer Weinblatt

*Attorney, Agent, or Firm*—Michael J. Kelly; James J. Farrell; Melvin H. Kurtz

[57] ABSTRACT

Particulate detergent compositions comprising a detergent active compound, an alkali metal carbonate and finely divided calcium carbonate, are made by contacting the alkali metal carbonate in particulate form with a liquid or pasty detergent active compound or mixture thereof and admixing the calcium carbonate in powder form with the alkali metal carbonate particles so that the calcium carbonate adheres thereto.

15 Claims, No Drawings

PRODUCTION OF DETERGENT COMPOSITIONS

The present invention relates to the production of detergent compositions in powder form which are particularly intended for fabric washing.

Fabric washing detergent compositions commonly incorporate as the major ingredients one or more detergent active compounds and a so-called detergency builder. Conventional detergency builders are usually inorganic materials, particularly the condensed phosphates, for example sodium tripolyphosphate. It has, however, been suggested that the use of these phosphate detergency builders can contribute to eutrophication problems. Alternative detergency builders which have been proposed, for example sodium nitrilotriacetate (NTA) and synthetic polymeric polyelectrolyte materials, tend to be more expensive or less efficient than the phosphate detergency builders, or otherwise unsatisfactory for one reason or another.

It is known that sodium carbonate can function as a detergency builder by removing the calcium from hard water in the form of precipitated calcium carbonate. But such calcium carbonate tends to accumulate on washing machine surfaces and on washed fabrics, and this can lead to fabric harshness.

In the specification of our UK patent No. 1,437,950, we have described detergent compositions which are based on an alkali metal carbonate detergency builder together with finely divided calcium carbonate, in addition to a detergent active compound or compounds. These compositions tend to form less inorganic deposits on washed fabrics, and hence decrease the fabric harshness which is normally a disadvantage of using alkali metal carbonate detergency builders. This is apparently because the precipitated calcium carbonate is deposited on the added calcium carbonate instead of on the fabrics or washing machine surfaces.

Moreover, by encouraging the calcium hardness in the wash water to be removed from solution in this way the detergencies of the compositions are improved compared with those compositions in which inorganic deposition on the fabrics is decreased by inhibition of the precipitation process, either by the addition of anti-deposition agents or by the action of precipitation inhibitors which we have found to be present in wash liquors. The added calcium carbonate also appears to act as a scavenger for the calcium carbonate precipitation inhibitors. This action facilitates the nucleation process and further encourages removal of calcium hardness from the wash liquor.

Those particulate detergent compositions based on an alkali metal carbonate detergency builder and finely divided calcium carbonate can be made by simple admixture of the ingredients. However, this can give rise to problems of segregation of the ingredients due to different particle sizes and densities, besides dust problems in the mixing processes. Spray drying can also be used, as is common practice for making most conventional fabric washing detergent powders, but this can give rise to problems due to the interaction between certain ingredients, especially with the finely divided calcium carbonate, the efficiency of which can be severely diminished by other ingredients present in the composition.

In the specification of our German patent application No. 2,539,429 we have described the production of detergent compositions comprising a detergent active compound, an alkali metal carbonate detergency builder and finely divided calcium carbonate, by admixture of a detergent base powder and granules formed from the finely divided calcium carbonate. With suitable selection of base powder and granule physical properties, the resultant compositions do not suffer from the usual problems described above for simple dry mixed products, and some reduction in the evaporative load may be achieved by not including the bulky calcium carbonate in the slurry for conventional spray drying. Moreover, the storage properties of the resultant detergent composition are improved by using the process described, and the activity of the calcium carbonate can be maintained by the selection of the optimum granulation conditions and the use of preferred additives in the granulation process.

However, it would be beneficial to have a simpler process to make the whole compositions whilst retaining good detergent properties.

According to the present invention, a particulate detergent composition comprising an alkali metal carbonate, a detergent active compound and finely divided calcium carbonate, is prepared by contacting the alkali metal carbonate in particulate form with a liquid or pasty detergent active compound or mixture thereof and admixing the finely divided calcium carbonate in powder form with the alkali metal carbonate particles so that the calcium carbonate adheres thereto.

The invention also includes the detergent compositions made by this process.

The use of the granulation process according to the invention prevents undue interaction between the alkali metal carbonate and the calcium carbonate in the compositions, which otherwise appears to cause some loss of effective surface area of the calcium carbonate to give decreased detergency and increased inorganic deposits on washed clothes. In addition the dispersion of the calcium carbonate in the wash liquor is improved on using the detergent compositions of the invention, which contributes to increased detergency by improving the detergency building effect of the alkali metal carbonate.

The amounts and types of the alkali metal carbonate used in the detergent compositions are generally the same as described in the specification of U.S. patent No. 1,437,950. More specifically, the alkali metal carbonate used is preferably sodium or potassium carbonate or a mixture thereof, for reasons of cost and efficiency. The carbonate salt is preferably fully neutralised, but it may be partially neutralised, for example a bicarbonate or sesquicarbonate may be used in partial replacement of the normal carbonate salt.

It may be desired to use a granular form of alkali metal carbonate of lower bulk density than normal in order to decrease the bulk density of the resultant particulate detergent composition, generally to within the normal range of about 25–35 lbs/cu ft. Such alkali metal carbonate may be made by spray drying, optionally in the presence of a so-called puffing agent, or other detergent ingredients, for example inorganic salts such as alkali metal sulphate. Examples of suitable puffing agents which can be used include sodium silicates, amine oxides, and anionic surface active materials such as soaps, alkyl sulphates, alkyl benzene sulphonates and alkenyl succinates. These are preferably used at levels of about 0.1–10%, especially about 1–5%, by weight of the resultant detergent compositions.

The alkali metal carbonate used is normally of relatively large particle size compared with the calcium carbonate and is preferably predominantly (ie at least 80%) within the range of about 0.1 mm to 0.5 mm and also having a mean particle size within this range, and also with no significant amount of particles having a dimension greater than about 1 mm. This can be achieved by using previously spray dried alkali metal carbonate, which can also improve the appearance and physical properties of the particulate detergent compositions.

The amount of the alkali metal carbonates in the detergent compositions can be varied widely from at least about 10% by weight, preferably from about 20% to 60% by weight, up to about 75% if desired in special products. The amount of the alkali metal carbonate is determined on an anhydrous basis, but the salts are preferably at least partly hydrated before coating with the detergent compounds in the production of the detergent compositions. This increases the rate of dissolution in water of the alkali metal carbonate and also improves its safety for domestic use. Such partial hydration is preferably equivalent to a water content of from about 7.5% to 20% by weight of the carbonate, which corresponds to a minimum of from about 50% formation of the monohydrate to full formation of the monohydrate and some higher hydrates. Hydration can be accomplished readily, for example by spray drying the alkali metal carbonate or by the addition of water to the particulate salt in a rotary mixing vessel, either as a preliminary step before coating with the detergent active compound, or at the same time as the coating takes place, for example by using an aqueous detergent compound solution. But in either case, there should be no substantial amount of free water present when the alkali metal carbonate particles are admixed with the calcium carbonate.

It should be mentioned that within the preferred range the higher levels of alkali metal carbonate tend to be required under conditions of use at low product concentrations, as is commonly the practice in North America, and the converse applies under conditions of use at higher product concentrations, as tends to occur in Europe. It should be noted that it may also be desirable to limit the carbonate content to a lower level within the range mentioned, so as to decrease the risk of internal damage following any accidental ingestion. This risk can be further decreased by replacing part of the alkali metal carbonate by bicarbonate or sesquicarbonate, and also by at least partial hydration of the carbonate.

The synthetic detergent active compound used preferably consists of or comprises a major proportion (ie at least 50%) of a nonionic detergent compound, many of which are commercially available and described in the literature, for example in "Surface Active Agents and Detergents", Volumes I and II, by Schwartz, Perry and Berch. They are generally condensation products of organic compounds having a hydrophobic group and a reactive hydrogen atom with an alkylene oxide, usually ethylene oxide. Examples of suitable nonionic compounds include condensation products of alkyl phenols, preferably with about 6-16 carbon atoms in the alkyl groups, with ethylene oxide, generally with 5 to 25 units of ethylene oxide per molecule (denoted as 5-25 EO); condensation products of aliphatic (preferably $C_8$-$C_{18}$) natural or synthetic linear or branched alcohols with ethylene oxide, generally 5-25 EO; and condensation products of polypropylene glycol with ethylene oxide. Other nonionic compounds which can be used are the condensation products of diols with alkylene oxides, especially ethylene oxide, for example alkane ($C_{10}$-$C_{20}$) diol - 5-12 EO condensates. Mixed nonionic compounds may be used if desired.

The amount of the preferred nonionic detergent active compounds is generally from about 1% to about 40%, preferably about 5% to about 20%, by weight of the detergent composition. The nonionic detergent compounds are preferably used alone or in admixture with other detergent compounds, because they are commonly liquids or meltable solids and are readily processable for spraying onto the alkali metal carbonate. Other detergent active compounds which can be used, preferably in combination with the nonionic detergent compounds, are anionic, amphoteric or zwitterionic detergent compounds, especially anionic detergent compounds which do not form insoluble calcium salts during use, for example alkyl sulphate and alkyl ether sulphate detergent compounds, and mixtures of alkyl benzene sulphonates with either of these or with nonionic detergent compounds. Many such detergent compounds are available commercially and described in the literature.

The calcium carbonate used should be finely divided, and should have a specific surface area of at least about 10 $m^2/g$, and preferably at least about 20 $m^2/g$. The particularly preferred calcium carbonate has a specific surface area of from about 30 $m^2/g$ to about 100 $m^2/g$, especially about 50 $m^2/g$ to about 85 $m^2/g$. Calcium carbonates with specific surface areas in excess of about 100 $m^2/g$ could be used, up to say about 150 $m^2/g$, if such materials are economically available. But it appears to be unlikely that any higher surface areas will be achievable commercially and this may in any case be undesirable for other reasons. For example, especially small particles, ie with very high specific surface areas, may have a tendency to contribute to the hardness in the wash liquor, and there may be dust problems during processing.

Surface areas of the calcium carbonate are determined by the standard Brunauer, Emmet and Teller (BET) method, using an AREA-meter made by Ströhlein & Co, and operated according to the suppliers' instruction manual. The procedure for degassing the samples under investigation is usually left to the operator, but we have found that a degassing procedure in which the samples are heated for 2 hours at 175° C. under a stream of dry nitrogen is effective to give repeatable results. Somewhat higher apparent surface areas may sometimes be obtained by degassing at lower temperatures under vacuum but this procedure is more time consuming and less convenient.

As an indication of the general relationship between particle size and surface area, we have found that calcite with a surface area of about 50 $m^2/g$ has an average primary crystal size (diameter) of about 250 Angstrom (Å), whilst if the primary crystal size is decreased to about 150 Å the surface area increases to about 80 $m^2/g$. In practice aggregation of the primary crystals generally takes place to form larger particles, irrespective of the granulation process. But it is desirable that the aggregated particle size of the calcium carbonate should be fairly uniform, and in particular that there should be not appreciable quantity of larger particles, for example over about 15μ, which after dispersion of the granules could easily get trapped in the fabrics being washed or possibly cause abrasive damage to washing machine parts.

Any crystalline form of calcium carbonate may be used, but calcite is preferred, as aragonite and vaterite appear to be more difficult to prepare with high surface areas, and it appears that calcite is a little less soluble than aragonite or vaterite at most usual wash temperatures. When any aragonite or vaterite is used it is generally in admixture with calcite. Suitable forms of calcium carbonate, especially calcite, are commercially available. The calcium carbonate is preferably in substantially pure form, but this is not essential, and the calcium carbonate used may contain minor amounts of other cations with or without other anions or water molecules.

Finely divided calcium carbonate can be prepared conveniently by precipitation processes, for example by passing carbon dioxide into a suspension of calcium hydroxide. Other chemical precipitation reactions may be employed to produce the calcium carbonate, especially the reaction between any sufficiently soluble calcium and carbonate salts, for example by reaction between calcium chloride or calcium hydroxide and sodium carbonate, but these reactions form aqueous slurries containing undesired dissolved salts, ie sodium chloride and sodium hydroxide in the examples mentioned. This means that the calcium carbonate would have to be filtered from the slurry and dried before use. Alternatively the calcium carbonate slurry may be dried without filtering if the dissolved salts can be tolerated in the particulate detergent compositions.

It should be mentioned that the calcium carbonate may be carried on a substrate, for example when it is formed by precipitation, in which case it may not be possible to measure accurately the surface area of the calcium carbonate alone. The effective surface area can then be calculated by checking the effectiveness of the calcium carbonate and relating this to the effectiveness of calcium carbonates of known surface areas. Alternatively, it may be possible to use electron microscopy to determine the average particle size, from which an indication of surface area might be obtained, but this should be checked by determining the effectiveness of the calcium carbonate in use.

Finely divided calcium carbonate may also be prepared by grinding minerals such as limestone or chalk, but this is not readily effective as it is difficult to obtain a high-enough surface area even with multiple milling.

The process of the present invention may be accomplished by any conventional granulation technique in which the alkali metal carbonate particles are coated with the detergent compound and admixed with the calcium carbonate. The most convenient methods of granulation are those in which the detergent compound is sprayed onto or otherwise mixed with the alkali metal carbonate, for example in a planetary mixer, an inclined pan, a rotating drum, or a fluidised bed, until granules are formed and the calcium carbonate is then added thereto. Alternatively, the alkali metal carbonate and calcium carbonate may be mixed together and the detergent compound added to the agitated mixture in a continuous process, so that the alkali metal carbonate and calcium carbonate become coated with the detergent compound and adhere together. It will be appreciated that in this process any hydration of the alkali metal carbonate must have been accomplished earlier, as there should be no appreciable free water present when the alkali metal carbonate and calcium carbonate come into contact.

It is preferred to heat the detergent compound to a temperature of from about 50°-100° C. to facilitate its spraying and uniform coating of the alkali metal carbonate particles. Some increase in temperature may also be caused by the heat of hydration of the alkali metal carbonate, preferably prior to the addition of the detergent compound.

The amount of the calcium carbonate used in the detergent compositions should generally be at least about 5% and preferably at least about 7.5% up to about 50%, more preferably from about 10% to about 30% by weight, of the detergent compositions. Within the broad range, the lower levels of calcium carbonate may be satisfactory under certain conditions of use and with particularly effective calcium carbonates. However, with less effective calcium carbonates and especially under conditions of use at low product concentration, as for example under typical North American washing conditions, it is preferred to use higher levels of calcium carbonate within the preferred range mentioned. The specific surface area of the calcium carbonate very markedly affects its properties, with high surface area materials being more effective, so that lower amounts of such materials can be used to good effect in comparison with calcium carbonates of low specific surface area.

In addition to the essential ingredients mentioned above, it is permissible to include in the detergent compositions of the invention any of the conventional detergent additives in the amounts in which such materials are commonly used in detergent compositions. Examples of such optical additives are lather boosters such as alkanolamides, particularly the monoethanolamides derived from palm kernel fatty acids and coconut fatty acids, lather depressants such as alkyl phosphates and silicone oils, anti-redeposition agents such as sodium carboxymethylcellulose, oxygen releasing bleaching agents such as sodium perborate and sodium percarbonate, peracid bleach precursors, chlorine releasing bleaching agents such as trichloroisocyanuric acid and alkali metal salts of dichloroisocyanuric acid, fabric softening agents, inorganic salts such as sodium sulphate, and, usually present in very minor amounts, fluorescent agents, perfumes, enzymes such as proteases and amylases, germicides and colourants.

These optional additives may be added when convenient during or after the production of the detergent compositions of the invention.

Another common detergent additive is sodium silicate which usually improves the physical properties of the detergent compositions, and also has a beneficial effect on detergency due to the pH buffer effect, usually in the range pH 9 to 11 for fabric washing purposes. Some sodium silicates, for example those having the ratio of $Na_2O:SiO_2$ at about 1:1 to 1:3.4, preferably sodium alkaline or neutral silicate, may be included in the present detergent compositions, for example in amounts up to about 20% by weight. However, it may be preferable to exclude sodium silicate or to use it only at low levels, for example in compositions containing nonionic detergent compounds, in order to decrease inorganic deposition on washed fabrics.

It is particularly preferred to include in the detergent compositions a solid per salt bleaching agent, especially sodium perborate mono- or tetra-hydrate or sodium percarbonate. The amount of the per salt bleaching agent is preferably from about 10% to about 30% by weight of the compositions. These bleaching agents may be added to the compositions at any convenient stage during processing, for example they may be admixed with the alkali metal carbonate before or after coating it with the detergent compound. Alternatively, the bleaching agent may be admixed with the resultant detergent compositions after the calcium carbonate has been added thereto.

The presence of any condensed phosphates in the detergent compositions has a deleterious effect on the properties of the detergent compositions, as they interfere with the precipitation of calcium carbonate by reaction between the alkali metal carbonate and calcium ions in the wash liquor. It is therefore preferred to have as little as possible, for example less than about 0.05% P, which is equivalent to about 0.2% sodium tripolyphosphate, in the detergent compositions.

The invention is illustrated in more detail by the following Examples in which parts and percentages are by weight, except where otherwise indicated.

EXAMPLE 1

A detergent composition was prepared to the following formulation:

| Ingredient | % |
|---|---|
| Nonionic detergent compound (alcohol $C_{12}$—$C_{15}$ — 8 EO) | 15 |
| Sodium carbonate | 35 |
| Calcite ($80^2$/g) | 20 |
| Sodium silicate ($Na_2O:SiO_2$, 1:2) | 5 |
| Sodium perborate monohydrate | 20 |
| Fluorescent agents, perfume | 1 |
| Water (of hydration) | 4 |

This composition was prepared by spraying water onto a mixture of anhydrous sodium carbonate and anhydrous sodium silicate to cause partial hydration, the amount of water being calculated to give sodium carbonate monohydrate. Mixing was continued in an inclined pan granulator to ensure that all the free water was taken up and the resultant powder was then sieved to remove any oversize particles. The nonionic detergent compound was then sprayed at a temperature of about 80° C. onto the hydrated sodium carbonate, and after mixing them the fluorescent agent and perfume were added. After further mixing the granular sodium perborate was added, followed by the dry calcite and mixing was then continued until the product was of uniform granular form. The resulting powder, which had a bulk density of 0.62 gm/cc, was non-dusty and readily dispersible in water.

Evaluation tests were undertaken to compare the detergent composition made as described above with a conventional commercially available low sudsing detergent powder containing 33% of sodium tripolyphosphate and 22% percarbonate bleach, both at equal dosage levels in similar washing machines.

For the purpose of evaluation the powder according to the invention was packed for use in disposable sealed paper sachets of the type described in our copending U.S. patent application Ser. No. 905,680 of even date (Case C. 1012). The sachets contained about 90 g of powder, and were so constructed as to prevent any significant loss of the detergent composition during handling or dry storage, but to release the detergent composition rapidly on addition to water. This is beneficial with detergent compositions which contain an insoluble ingredient, namely the calcium carbonate in the present compositions, and which otherwise would be less effective in use.

The evaluation tests showed general similarity in wash performance for both products, but with noticeable benefits in bleachable stain removal for the composition of this Example under the conditions of use in (25° F.) hard water at 95° C., despite the absence of sodium tripolyphosphate from the compositions of the invention.

EXAMPLE 2

A further product was made to the same formulation as described above, except that the sodium silicate was replaced by 2% of dimethyl coco-alkyl amine oxide and the water content was increased to 7% of the composition. In this process the sodium carbonate was firstly spray dried from an aqueous slurry also containing the amine oxide to give a powder having a bulk density of 0.36 gm/cc. The rest of the process was then done as before to give a final product having a bulk density of 0.52 gm/cc. This particulate product has an appearance and physical properties suitable for packaging in cartons, and was found to have satisfactory detergent properties.

EXAMPLES 3 TO 10

A series of detergent compositions were prepared by the procedure as described in Example 1, but using different amounts and types of ingredients, as shown in the following Table:

TABLE

| Ingredients | Ex: 3 | 4 | 5 | 6 | 7 | 8 | 9 | 10 |
|---|---|---|---|---|---|---|---|---|
| Nonionic detergent[1] | 8.0 | 8.0 | 15.0 | 8.0 | 15.0 | 15.0 | 14.0 | 14.0 |
| Sodium alkyl benzene sulphonate | 5.0 | 5.0 | — | 5.0 | — | — | — | — |
| Soap | 2.0 | 2.0 | — | 2.0 | — | — | — | — |
| Sodium carbonate[2] | 37.0 | 37.0 | 40.0 | 40.0 | 60.0 | 20.0 | 34.0 | 34.0 |
| Calcium carbonate[3] | 19.0 | 19.0 | 15.0 | 15.0 | 15.0 | 19.0 | 18.0 | 18.0 |
| Sodium perborate . $4H_2O$ | — | — | — | — | — | 30.0 | 25.0 | 25.0 |
| Sodium percarbonate | 22.0 | 22.0 | 22.0 | 22.0 | — | — | — | — |
| Sodium sulphate | — | — | — | — | — | 10.0 | — | — |
| SCMC | 1.0 | 1.0 | 1.0 | 1.0 | 1.0 | 1.0 | 3.3 | 3.3 |
| Fluorescent agent, perfume and | 6.0 | 6.0 | 7.0 | 7.0 | 7.0 | 5.0 | 5.7 | 5.7 |

TABLE-continued

| Ingredients | Ex: 3 | 4 | 5 | 6 | 7 | 8 | 9 | 10 |
|---|---|---|---|---|---|---|---|---|
| moisture[4] | | | | | | | | |

[1]Alcohol $C_{12}$-$C_{15}$-8 EO in all these examples except for Examples5 and 6 which containedtallow alcohol - 18 EO.
[2]Produced by spray drying an aqueous sodium carbonate suspension, to give a product with a mean particle size of about 0.3 mm, about 90% of the sodium carbonate particles being within the size range of 0.1 to 0.5 mm and none being more than 1 mm.
[3]Calcite surface area 60 $m^2/g$ in all examples except for calcite of 40 $m^2/g$ in Example 4 calcite of 10 $m^2/g$ in Example 9, and calcite of about 20 $m^2/g$ in Example 10.
[4]The moisture was present as water of hydration in the sodium carbonate.

All of these compositions had good powder properties, with bulk densities in the range from about 0.63 to 0.74 gm/cc, and they were found to give satisfactory washing results in halved article detergency tests on naturally soiled fabrics.

EXAMPLE 11

A detergent powder was made by a continuous granulation process in which all the dry particulate ingredients were premixed and then fed on a weigh-belt at a constant rate to an inclined pan granulator of 1 meter diameter. The nonionic detergent compound was heated to 50° C., and the perfume admixed with it, and then sprayed onto the dry ingredients in the pan granulator at a constant rate according to the relative amounts in the end product, whilst finished mixed product was constantly removed from the apparatus.

The product had the following formulation:

| Ingredient | % |
|---|---|
| Alcohol ($C_{12}$—$C_{15}$) — 8 EO | 15.0 |
| Sodium carbonate[1] | 35.0 |
| Sodium lauryl sulphate | 2.0 |
| Calcium carbonate[2] | 19.0 |
| Sodium percarbonate | 22.0 |
| Fluorescent agent | 0.8 |
| SCMC | 1.0 |
| Moisture[1] and perfume | 5.2 |

[1]The sodium carbonate was mainly in monohydrate form, obtained by spray drying an aqueous suspension of sodium carbonate containing the sodium lauryl sulphate to decrease the density of the product. The amount of sodium carbonate is expressed on an anhydrous basis and the water of crystallisation is listed separately.
[2]Calcite having a surface area of about 60 $m^2/g$.

This detergent composition was found to have a bulk density of 0.67 gm/cc and good physical properties. Evaluation of the detergent properties of the composition in halved article tests in domestic automatic washing machines at 60° C. and 95° C. showed a small benefit for the product according to the invention against a leading commercially available sodium tripolyphosphate-built detergent powder.

What is claimed is:

1. In a process for making a particulate detergent composition comprising from about 10% to about 75% of an alkali metal carbonate, from about 1% to about 40% of a detergent active compound and from about 5% to about 50% of finely divided calcium carbonate having a surface area of at least about 10 $m^2/g$, the improvement consisting essentially of contacting sodium or potassium carbonate or a mixture thereof in particulate form with a liquid or pasty detergent active compound or mixture thereof which contains a major proportion of a nonionic detergent compound and admixing the calcium carbonate in powder form with the alkali metal carbonate particles so that the calcium carbonate adheres thereto.

2. A process according to claim 1, wherein the calcium carbonate is added after the alkali metal carbonate has been treated with the detergent active compound.

3. A process according to claim 1, wherein the detergent active compound is added to mixed alkali metal carbonate and calcium carbonate.

4. A process according to claim 1, wherein the alkali metal carbonate is sodium carbonate.

5. A process according to claim 1, wherein the alkali metal carbonate is at least partially hydrated prior to addition of the calcium carbonate.

6. A process according to claim 1, wherein the alkali metal carbonate is spray dried.

7. A process according to claim 1, wherein the alkali metal carbonate has a mean particle size of 0.1 mm to 0.5 mm and with at least 80% by weight of the particles being within this range.

8. A process according to claim 1, wherein the calcium carbonate is calcite.

9. A process according to claim 1, wherein the calcium carbonate has a surface area of from about 10 $m^2/g$ to about 100 $m^2/g$.

10. A process according to claim 1, wherein the amount of the detergent active compound is from about 5% to about 20% by weight of the composition.

11. A process according to claim 1, wherein the detergent compound is heated to a temperature of from about 50°-100° C. and sprayed onto the alkali metal carbonate.

12. A process according to claim 1, wherein sodium perboate mono- or tetra-hydrate or sodium percarbonate is admixed with the alkali metal carbonate before or after contact with the detergent active compound.

13. A process according to claim 1, wherein the resultant composition comprises not more than about 0.05% phosphorus.

14. A process according to claim 1, wherein sodium silicate is added to the alkali metal carbonate in an amount of not more than about 5% by weight of the composition.

15. A particulate detergent composition made by a process according to claim 1.

* * * * *